US011510532B2

(12) United States Patent
Jennings et al.

(10) Patent No.: US 11,510,532 B2
(45) Date of Patent: Nov. 29, 2022

(54) APPARATUS FOR DISPENSING AND COLLECTING

(71) Applicant: Sense of Security USA, LLC, Kenton, OH (US)

(72) Inventors: Matthew Jennings, Kenton, OH (US); Jeremy Streets, Ridgeway, OH (US)

(73) Assignee: Sense of Security USA, LLC, Kenton, OH (US)

( * ) Notice: Subject to any disclaimer, the term of this patent is extended or adjusted under 35 U.S.C. 154(b) by 0 days.

(21) Appl. No.: 17/233,912

(22) Filed: Apr. 19, 2021

(65) Prior Publication Data

US 2021/0321834 A1 Oct. 21, 2021

Related U.S. Application Data

(60) Provisional application No. 63/013,221, filed on Apr. 21, 2020.

(51) Int. Cl.

| | |
|---|---|
| ***A47K 10/46*** | (2006.01) |
| ***A47K 10/42*** | (2006.01) |
| *A47K 10/32* | (2006.01) |

(52) U.S. Cl.

CPC ..... *A47K 10/46* (2013.01); *A47K 10/421* (2013.01); *A47K 2010/3233* (2013.01); *A47K 2010/3266* (2013.01)

(58) Field of Classification Search

None

See application file for complete search history.

(56) References Cited

U.S. PATENT DOCUMENTS

| | | | | |
|---|---|---|---|---|
| 2001/0035416 | A1* | 11/2001 | Dodson | A47K 10/421 220/826 |
| 2006/0226316 | A1* | 10/2006 | Sellers | A47B 96/061 248/235 |
| 2009/0223991 | A1* | 9/2009 | Lorenzati | A47K 10/424 221/34 |

OTHER PUBLICATIONS

Clorox Company, Clorox Disinfecting Wipes Multi-Surface Cleaning, webpage, accessed Jul. 30, 2021, 7 pages.

Lysol, Lysol Disinfecting Wipes, wepbage, accessed Jul. 30, 2021, 4 pages.

* cited by examiner

*Primary Examiner* — Gene O Crawford

*Assistant Examiner* — Ayodeji T Ojofeitimi

(74) *Attorney, Agent, or Firm* — Standley Law Group LLP; Jeffrey S. Standley; Kenny W. Pung

(57) ABSTRACT

An apparatus that includes a dispensing container, a collecting container and a mount. The dispensing container and the collecting container each includes a receptacle having an open end, a lid configured to be received over the open end, an interior space defined by the receptacle and the lid, and an opening into the interior space. The mount is configured to be attached to a structure and is further attached to at least one of the dispensing container and the collecting container.

19 Claims, 12 Drawing Sheets

APPARATUS FOR DISPENSING AND COLLECTING

CROSS-REFERENCE TO RELATED APPLICATION

This application is a non-provisional patent application and makes a priority claim to U.S. Provisional Application No. 63/013,221.

TECHNICAL FIELD

Exemplary embodiments of the present invention relate generally to an apparatus for dispensing and collecting single-use items.

BACKGROUND

The global spread of pathogens (e.g., viruses, bacteria, fungus, etc.) has caused the outbreak of diseases throughout the world. These outbreaks include, for example, the Western African Ebola virus epidemic (2013-2016) and the Coronavirus pandemic (2019-2020). As a result of these outbreaks, people have been encouraged by governments, health systems, and the like, to take precautionary measures to eliminate these pathogens and combat the spread of these diseases. These precautionary measures may include, for example, adequate hand washing, social distancing, and the cleaning of frequently touched surfaces.

Specifically, in regards to the cleaning of frequently touched surfaces (or any other surface that may be near or in contact with people), it is common to use disinfectant wipes as quick, easy way of disinfecting that surface. These wipes may include, for example, Clorox Disinfecting Wipes available from the Clorox Company of Oakland, Calif., or Lysol Disinfecting Wipes available from Reckitt Benckiser Group, PLC, of Slough, England. However, in times of scarcity, these wipes (as well as other cleaning supplies) may be in short supply due to increased demand, theft, and/or otherwise being lost. As such, owners/proprietors of public places (e.g., restaurants, ball parks, etc.) may be reluctant to make these wipes available to the public.

SUMMARY

Disclosed are apparatus for dispensing and collecting items.

In a first embodiment, the apparatus includes a dispensing container that includes a first receptacle having an open end, a first lid configured to be received over the open end of the first receptacle, a first interior space defined by the first receptacle and the first lid, and an opening defined in the first lid that extends into the first interior space. The apparatus also includes a collecting container that includes a second receptacle having an open end, a second lid configured to be received over the open end of the second receptacle, and a second interior space defined by the second receptacle and the second lid, wherein the collecting container further comprises an opening into the second interior space. The apparatus further includes a mount configured to be attached to a structure, wherein the mount is attached to at least one of the dispensing container and the collecting container.

In a second embodiment, the apparatus includes a dispensing container that includes a first receptacle having an open end, a first lid configured to be received over the open end of the first receptacle, a first interior space defined by the first receptacle and the first lid, and an opening defined in the first lid that extends into the first interior space. The apparatus also includes a collecting container that includes a second receptacle having an open end, a second lid configured to be received over the open end of the second receptacle, a second interior space defined by the second receptacle and the second lid, and an opening defined in the second lid that extends into the second interior space. The apparatus further includes a first mount releasably attachable to the dispensing container, and configured to secure the dispensing container to a structure, as well as a second mount releasable attachable to the collecting container, and further configured to secure the collecting container to a structure.

In a third embodiment, the apparatus includes a dispensing container that includes a first receptacle having an open end, a first lid configured to be received over the open end of the first receptacle, a first interior space defined by the first receptacle and the first lid, and an opening defined in the first lid that extends into the first interior space, the dispensing container further comprising a first elongated dovetail. The apparatus also includes a collecting container that includes a second receptacle having an open end, a second lid configured to be received over the open end of the second receptacle, a second interior space defined by the second receptacle and the second lid, and an opening defined in the second lid that extends into the second interior space, the collecting container further comprising a second elongated dovetail. The apparatus further includes a mount comprising a first dovetail slot configured to receive the first elongated dovetail, and a second dovetail slot configured to receive the second elongated dovetail.

Other examples of the disclosed notebook binding system will become apparent from the following detailed description, the accompanying drawings and the appended claims.

DETAILED DESCRIPTION

Figure 1:
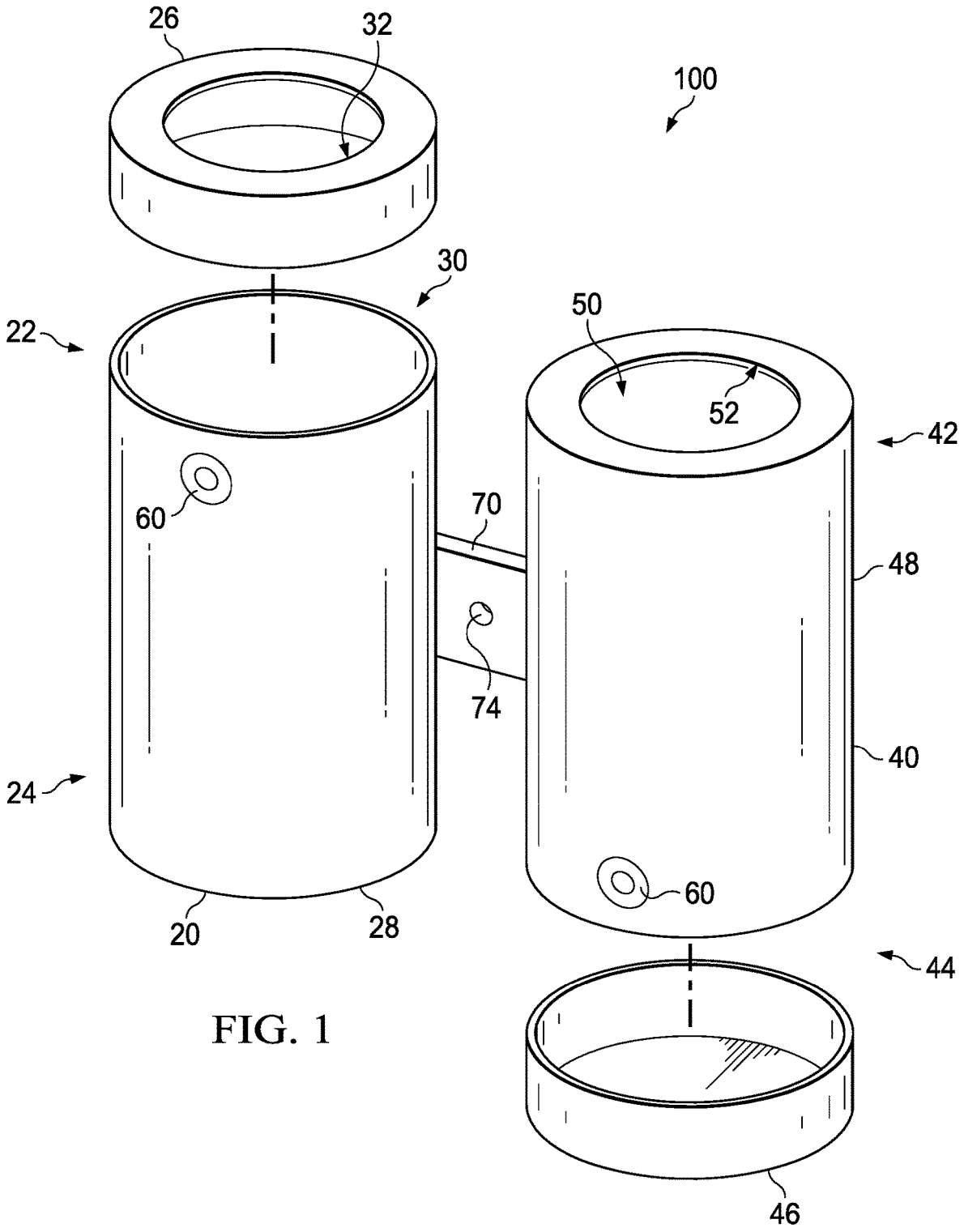
FIG. 1 is a top perspective view of a first embodiment of the apparatus for dispensing and collecting.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

Figure 2:
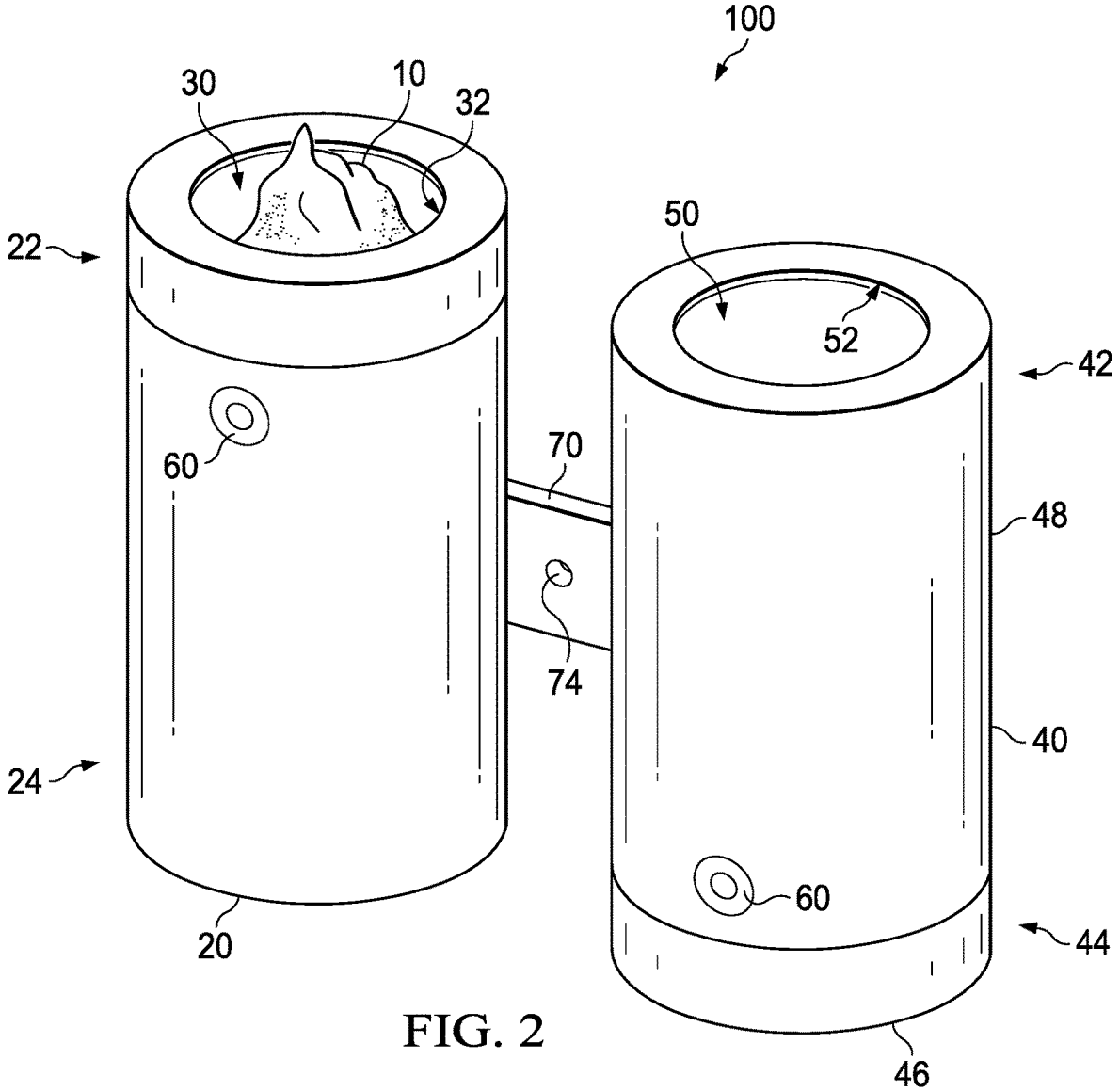
FIG. 2 is a top perspective view of the apparatus of FIG. 1 with the lids closed.
Figure 5:
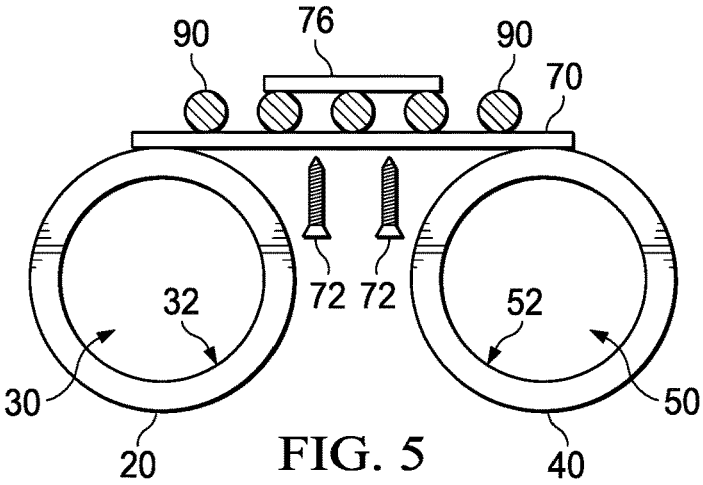
FIG. 5 is a top plan view of the apparatus of FIG. 1 being attached to a structure.
Figure 13:
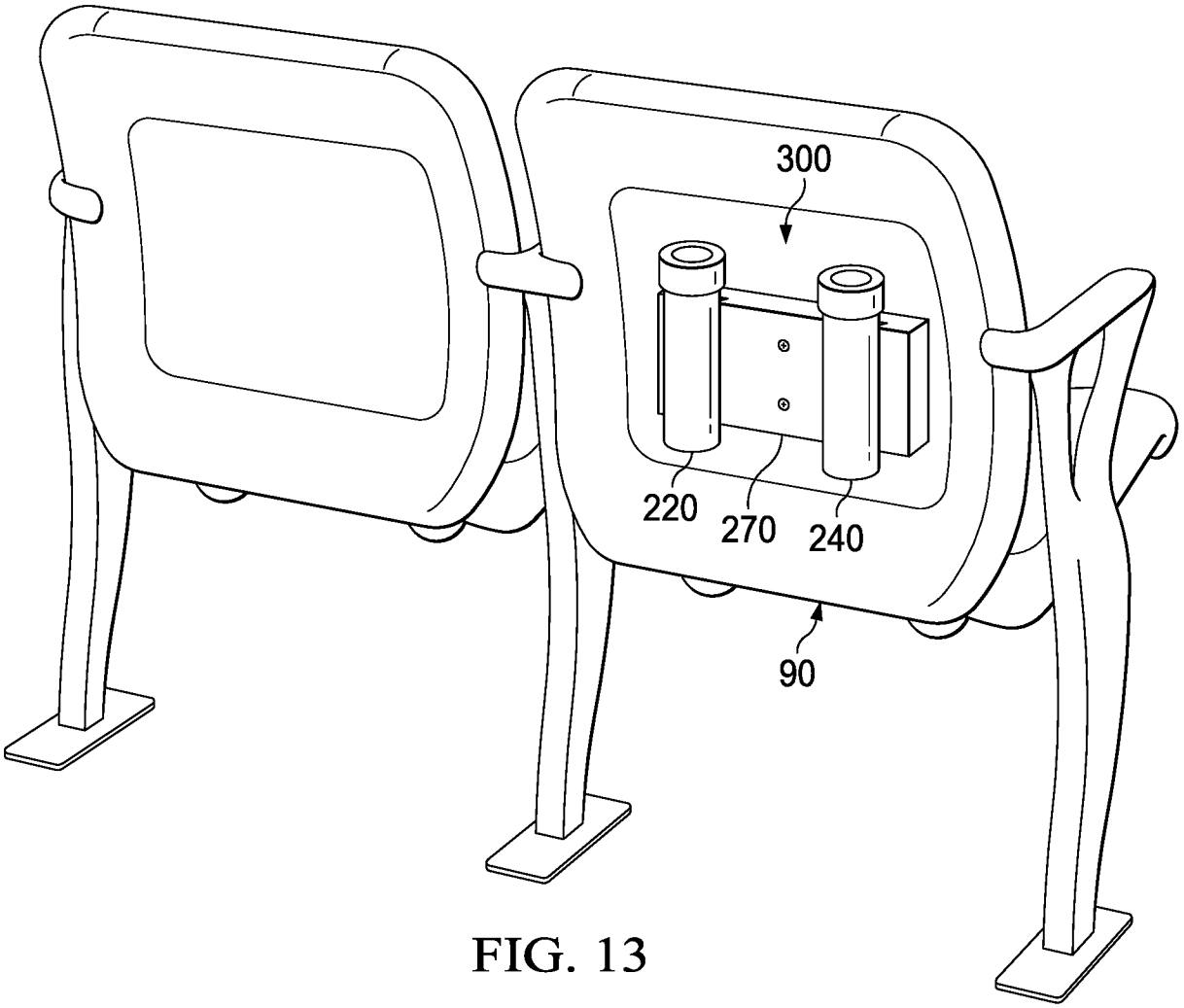
FIG. 13 is a top perspective view of the apparatus of FIG. 12.

Referring to FIGS. 1 and 2, the present disclosure provides examples of an apparatus 100 for dispensing and collecting items. The apparatus 100 includes a dispensing container 20, a collecting container 40, and a mount 70. The dispensing container 20 may be utilized to contain and dispense unused items 10 (FIG. 2), while the collecting container 40 collects and retains those items 10 post-use. The mount 70 may be used to attach the dispensing and collecting containers 20, 40 to a desired structure 90 (FIG. 5), or to orient the containers 20, 40 as desired (FIG. 13).

Ostensibly, the apparatus 100 may be utilized to dispense and collect items 10 of any suitable variety. However, it is generally contemplated that the apparatus 100 might be best suited to dispense and collect, for example, disposable, single-use items such as sanitation wipes, tissues, napkins, plastic cutlery, associated packaging, and the like. By providing separate containers, one for dispensing and one for collecting, a clean, sterile environment for the items may be maintained.

Figure 4:
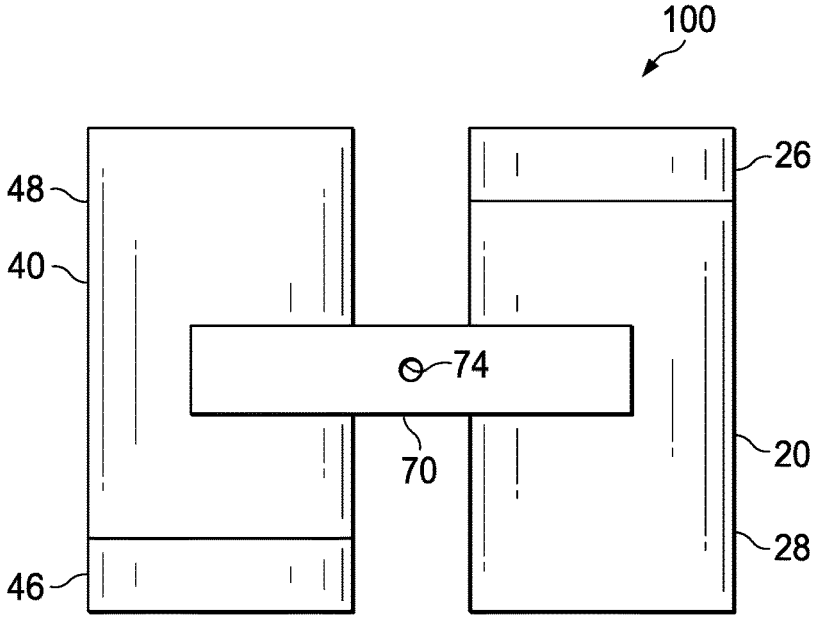
FIG. 4 is a rear elevational view of the apparatus of FIG. 1.

As depicted, the dispensing and collecting containers 20, 40 may be generally cylindrical in shape, substantially equal in size, and oriented parallel to one another (FIG. 4). However, the size, shape, and orientation of the dispensing container 20 and/or the collecting container 40 need not be limiting features. For example, containers having polygonal or irregular shapes (in cross-section) may be employed instead of cylindrical containers. Alternatively or additionally, containers of differing sizes (such that the dispensing container or the collecting container is larger than the other) may be employed instead of containers of equal size. Alternatively or additionally, non-parallel orientations may also be utilized.

Whatever the size, shape, and orientation, the dispensing and collecting containers 20, 40 may each generally include a top portion 22, 42 and a bottom portion 24, 44. Lids 26, 46 may be disposed on the top portions 22, 42, the bottom portions 24, 44, or both portions of the dispensing container 20 and the collecting container 40. As those skilled in the art will appreciate, lids 26, 46 disposed on the top portions 22, 42 may enable items to be loaded into the dispensing container 20 and/or emptied from the collecting container 40, from above. Lids 26, 46 disposed on the bottom portions 24, 44 may enable items to be quickly dropped out of the bottoms thereof. While various configurations are contemplated, the present disclosure provides four non-limiting embodiments of the apparatus, each of which are discussed in turn below.

Still referring to FIGS. 1 and 2, a first embodiment of the apparatus 100 is shown. Here, the dispensing container 20 includes a receptacle 28, a lid 26 disposed along its top portion 22, and an interior space 30 defined by the lid 26 and the receptacle 28. The lid 26 may be coupled to the receptacle 28 by any suitable means such as, but not limited to, hinge brackets, friction fits, and the like. Further, an opening 32 is provided in the lid 26 that extends into the interior space 30. This opening 32 is generally circular in shape and disposed radially centered along the top surface of the lid 26. When the lid 26 is coupled to the receptacle 28, items 10 within the interior space 30 may be dispensed through the opening 32 in the lid 26.

The collecting container 40 also includes a lid 46, a receptacle 48, an interior space 50 (defined by the lid 46 and the receptacle 48), and an opening 52 disposed along its top portion 42 (extending into the interior space). However, the opening 52 is located on the receptacle 48 (instead of the lid 46) and the lid 46 is disposed on the bottom portion 44 of the collecting container 40 (instead of the top portion 42). This configuration enables items 10 to be inserted through the opening 52 and then removed from the interior space 50 of the collecting container 40 by being dropped out the bottom. Further, like with the dispensing container 20, the lid 46 may be coupled to the receptacle 48 by any suitable means such as, but not limited to, hinge brackets, friction fits, and the like.

In one or more examples, the dispensing container 20 and the collecting container 40 may also be provided with a locking feature 60 that locks the respective lids 26, 46 onto the respective receptacles 28, 48. Doing so secures the contents of either container within their respective interior spaces 30, 50 thereby preventing the loss of items 10 (e.g., theft). This locking feature 50 may include any suitable locking mechanism, such as, for example, cam locks, deadbolts, padlocks, and the like. In the example shown, hex key cam locks are used for both containers.

Figure 3:
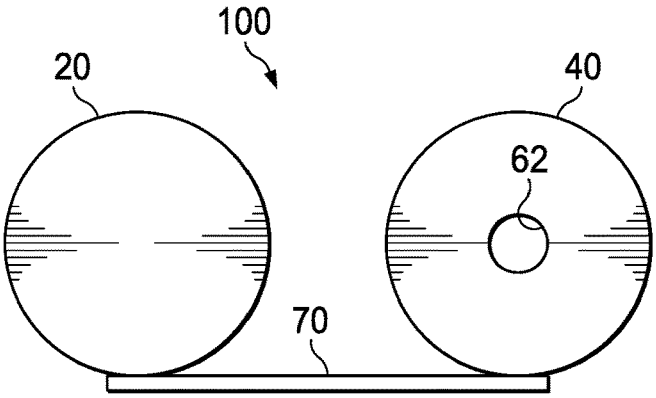
FIG. 3 is a bottom view of the apparatus of FIG. 1.

Referring to FIG. 3, in one or more examples, the dispensing and collecting containers 20, 40 may further be provided with one or more drainage holes 62 to permit liquids (e.g., rain water) within the container to drain out. Doing so may prevent the growth of bacteria/mold within the container, and may allow the items 10 within to at least partially dry. Of course, such a drainage hole 62 should be sized and shaped to retain the items 10 within the interior space, until such time they are ready to be removed. As shown, these drainage hole(s) 62 may be disposed along the bottom portion 44 of the collecting container 40 (e.g., on lid 46).

Referring to FIG. 4, the dispensing container 20 and the collecting container 40 are shown as being attached to the opposing ends of the mount 70, approximately halfway up. The containers 20, 40 may be attached to the mount 70 by any suitable means. For example, releasable mechanisms (e.g., mechanical fasteners) and/or non-releasable mechanisms (e.g., adhesives) may be employed. In other examples, either one or both of the dispensing container 20 and the collecting container 40 may even be fabricated with the mount 70 as a single monolithic piece (e.g., additive manufacturing).

The mount 70 may attach the dispensing and collecting containers 20, 40 to a structure 90 such as, but not limited to, walls, fences, doors, door knobs, shopping carts, bleacher seats (e.g., underneath), cup holders, gas pumps, automated teller machines, and drive-through units (e.g., at banks, restaurants, etc.). In an exemplary embodiment, the bottom side of stadium seats (which fold upwards to close) may also be a suitable structure for attachment.

The mount 70 shown in FIG. 4 comprises a generally flat, rectangular member, with the dispensing and collecting container 20, 40 attached to one side thereof. This mount 70 may be best suited for attaching the dispensing and collecting containers 20, 40 to structures having planar surfaces. Structures having curved surfaces, however, may also be accommodated by providing an appropriately curved mount 70 (not shown). Further, the mount 70 may be attached to the structure 90 by any suitable means (e.g., mechanical fasteners, hangers, suction cups, adhesives, etc.). In the example shown in FIGS. 1-4, conventional screws 72 may be used to mechanically fasten the mount 70 to the structure 90, with holes 74 provided in the mount 90 through which screws 72 may be inserted. If needed, a backplate 76 with corresponding holes may be provided (FIG. 5), which may be desirable for structures 90 having non-solid construction (e.g., fences, railing, netting, etc.). Doing so may enable the mount 70 and the backplate 76 to clap the structure 90 therebetween.

Figure 6:
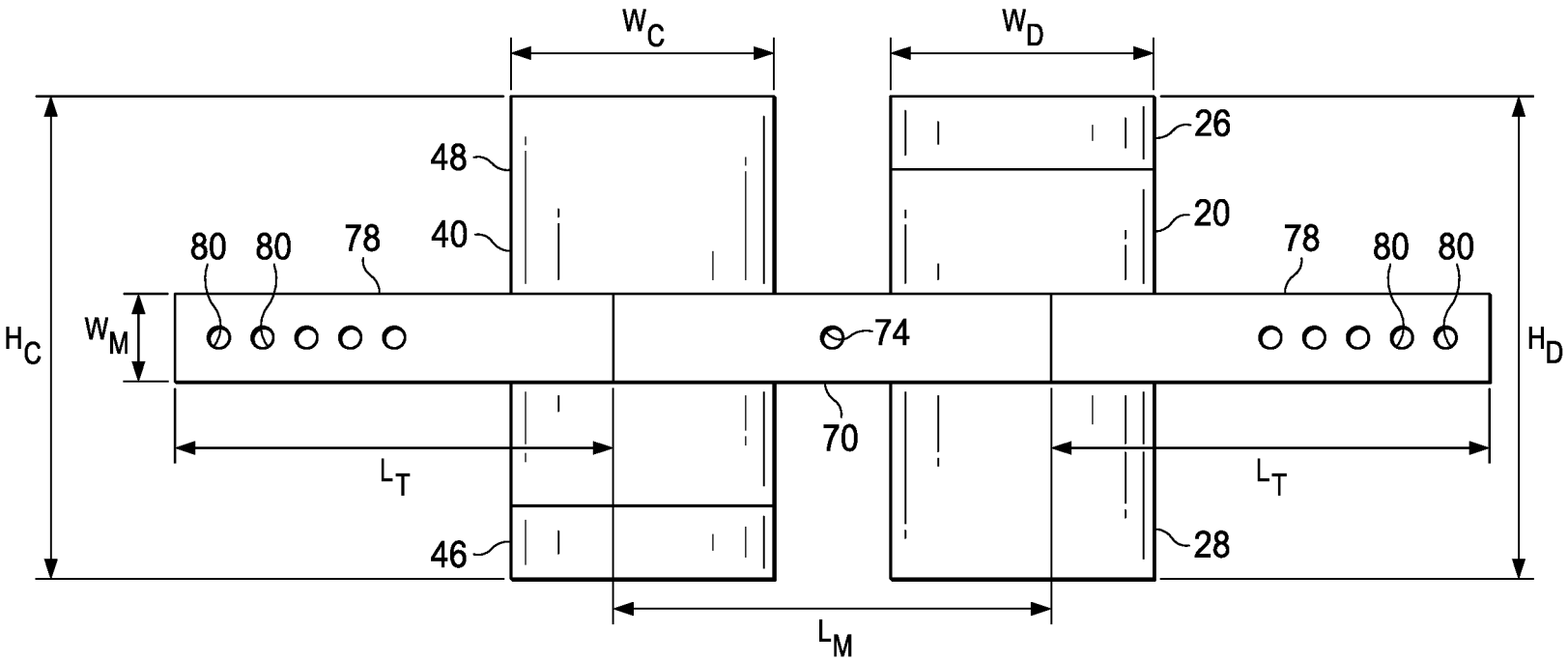
FIG. 6 is a rear elevational view of the apparatus of FIG. 1 that includes tabs.

Referring to FIG. 6, an alternative embodiment of a mount 70 is shown. This mount 70 includes tabs 78 extending from each of its end portions, which may be used to wrap around the structure 90 and provide longitudinal stabilization to the apparatus 100 (e.g., parallel with the attachment member). Further, these tabs 78 each include a series of holes 80 disposed along the length of each tab 78. In practice, mechanical fasteners (such as the aforementioned varieties) may be selectively inserted through one or more of these holes 80 depending on the size of the structure 90 and the length of the tabs 78. This specific example of a mount 70 may be particularly suitable for structures 90 having curved surfaces. The bottom side of stadium seats (which typically ranges from 19" to 25" in width) may be one example of such a structure.

The present disclosure will now describe a first exemplary example of the apparatus 100 for dispensing and collecting. The dispensing container and the collecting container may be sustainably identical in both size and shape, with each defining a height and a width. In this example, the height $H_D$, $H_C$ of the containers 20, 30 may range from about 6 inches to about 8 inches (preferably 7 inches), and the width $W_D$, $W_C$ of the containers 20, 30 may range from about 2 inches to about 3 inches (preferably 2.5 inches). Further, the mount 40 may define length $L_M$ and width $W_M$, with the length $L_M$ ranging from about 4 inches to about 6 inches (preferably 5 inches), and the width $W_M$ ranging from about 1 inch to about 2 inches (preferably 1.5 inches).

The present disclosure will now provide a second exemplary example of the apparatus 100 for dispensing and collecting. In this example, the height $H_D$, $H_C$ of the containers 20, 30 may range from about 8.5 inches to about 10.5 inches (preferably 9.5 inches), and the width $W_D$, $W_C$ of the containers 20, 30 may range from about 2.5 inches to about 3.5 inches (preferably 3 inches). Further, the attachment member 40 may define length $L_A$ and width $W_A$, with the length $L_A$ ranging from about 5 inches to about 7 inches (preferably 6 inches), and the width $W_A$ ranging from about 1.5 inches to about 2.5 inches (preferably 2 inches). The mount 40 may also include tabs 56 extending from the end portions 44 of the attachment member 40. These tabs 56 may range from about 3 inches to about 6 inches in length LT (preferably 4.5 inches). As configured, these tabs 56 may enable the apparatus to be attached to, among other things, the bottom side of stadium seats.

Figure 7:
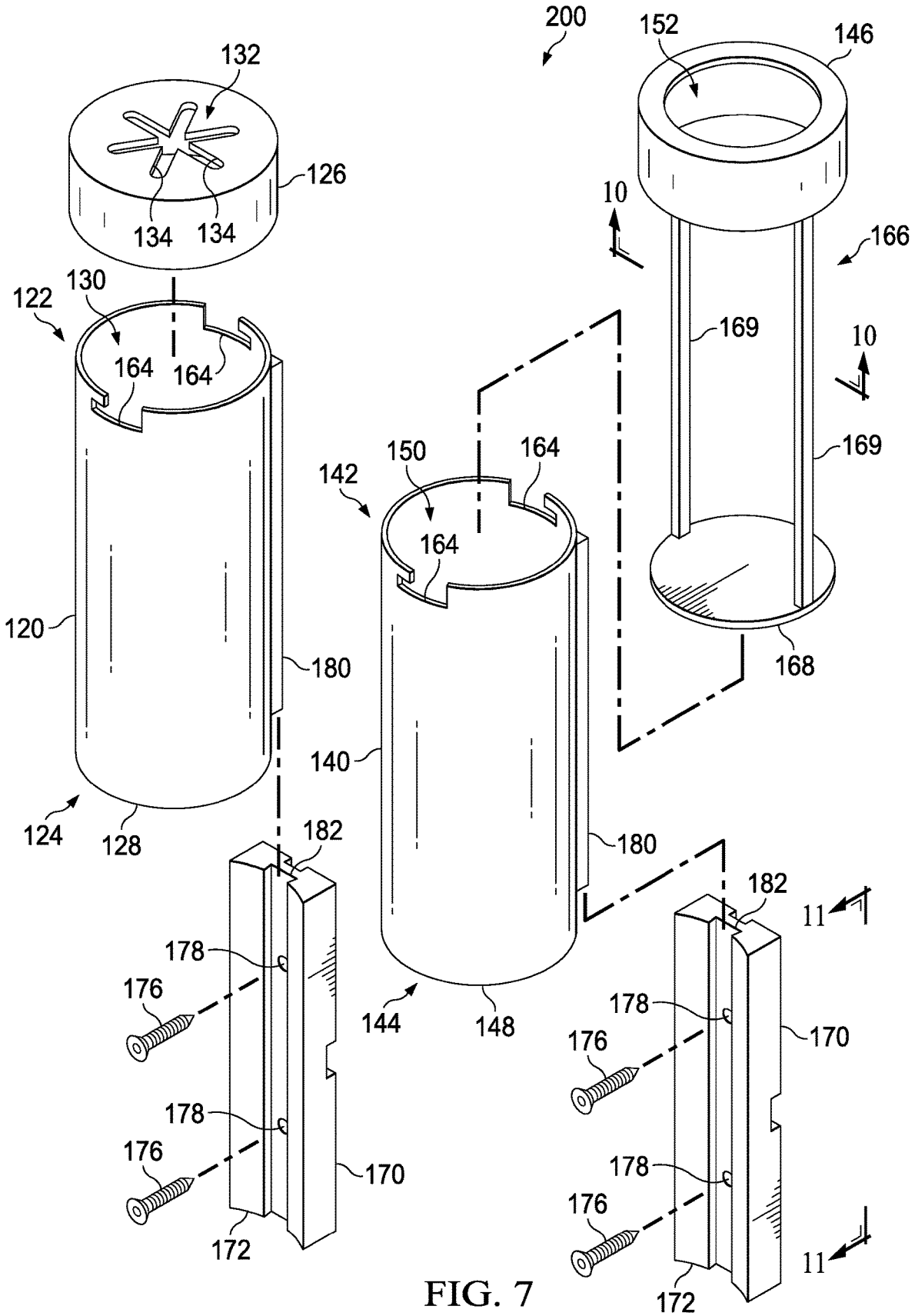
FIG. 7 is an exploded top perspective view the be apparatus of a second embodiment of the apparatus for dispensing and collecting.
Figure 8:
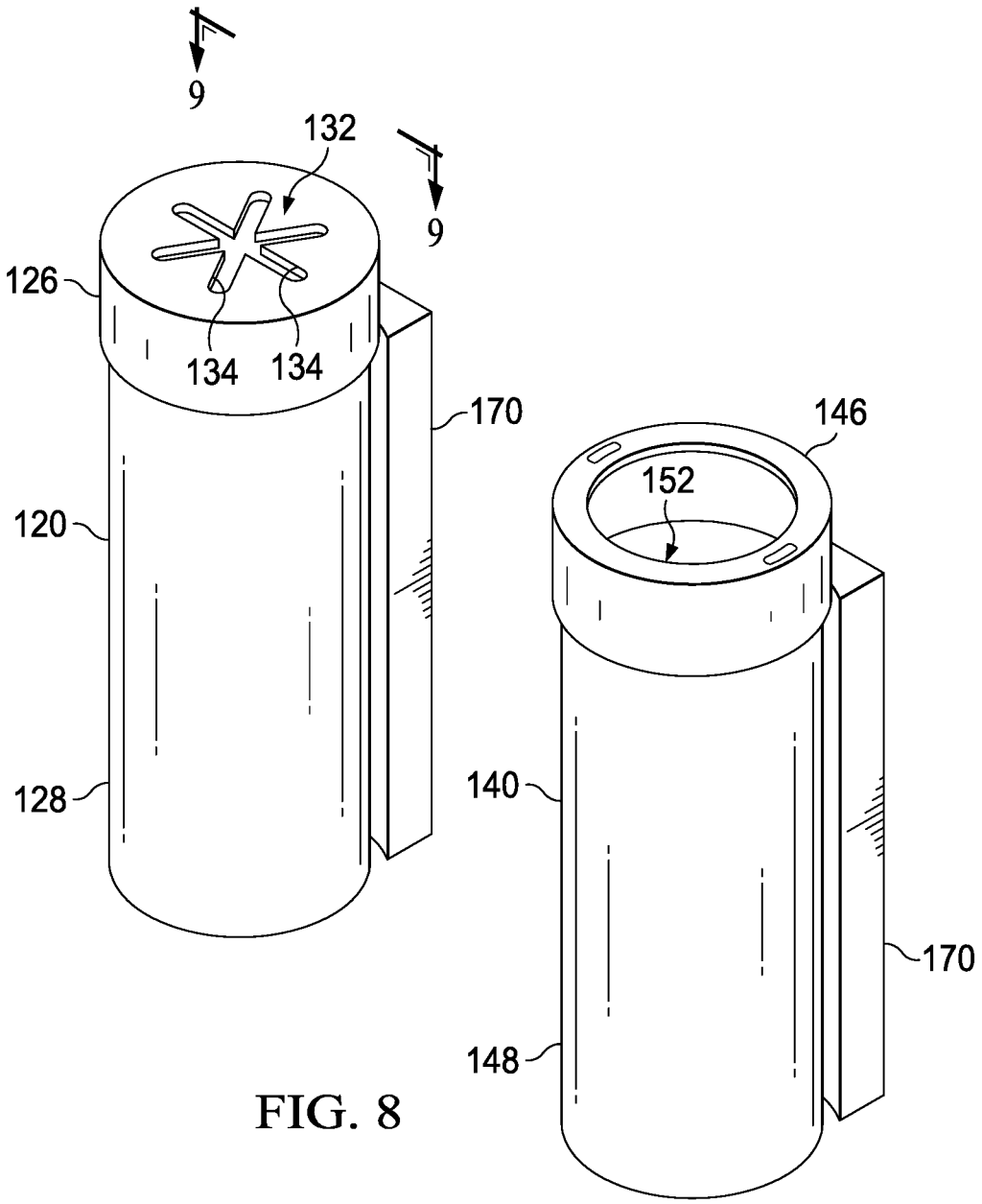
FIG. 8 is a top perspective view of the apparatus of FIG. 7.
Figure 9:
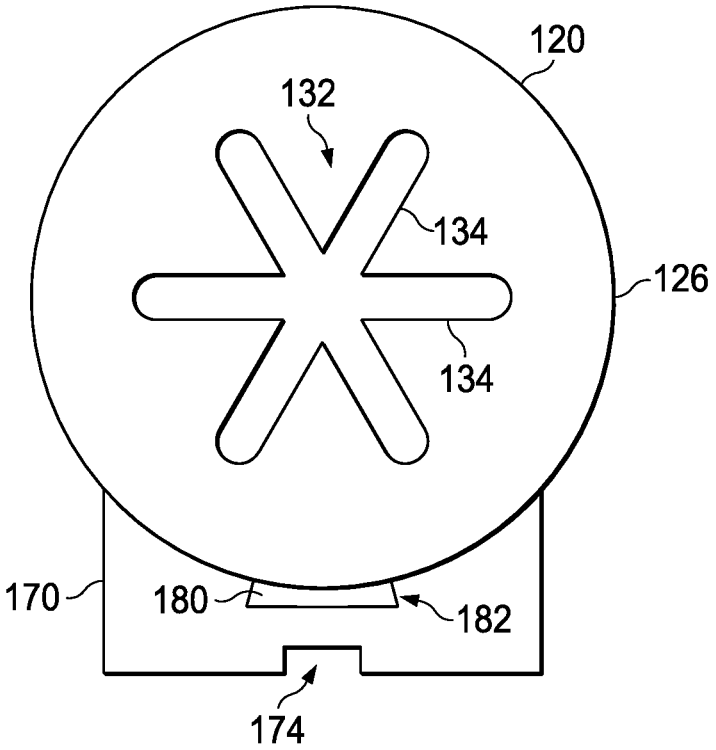
FIG. 9 is a top plan view of the dispensing container of FIG. 8.

Referring to FIGS. 7 and 8, a second embodiment of the apparatus 200 is shown. Here, the dispensing container 120 may be generally the same as the dispensing container 20 of the first embodiment (albeit, thinner). More specifically, the dispensing container 120 includes a receptacle 128, a lid 126 disposed along its top portion 122, an interior space 130 defined by the lid 126 and the receptacle 128, and an opening 132 in the lid 126 that extends into the interior space 130. The opening 132 is different, however, from the opening 32 of the first embodiment in that it defines a star shape comprising a circular center point with six slots 134 extending radially outwards therefrom (FIG. 9). These slots 134 are spaced generally equidistant relative to one another and are generally identical in size and shape. In practice, these slots 134 may facilitate the dispensing of sanitation wipes by helping to create separation between wipes as they are dispensed through the opening 132 in the dispensing container 120. In other embodiments, however, openings of different shapes may also be employed without departing from the scope of the present disclosure.

The collecting container 140 of the second embodiment differs slightly from the collecting container 40 of the first embodiment in that the lid 146 is disposed along the top portion 142 of the container instead of the bottom portion 144, with the opening 152 extending through the lid 146. With this configuration, users may dispose of items 10 by inserting the items 10 through the opening 152 in the lid 146, which may then be removed by opening the lid 146 and taking the used items 10 out of the collecting container 140 through the top.

In exemplary embodiments, the dispensing container 120 and/or the collecting container 140 may be provided with coupling features on their lids 126, 146 and receptacles 128, 148 that help to secure the lids 126, 146 on the receptacles 128, 148. For example, small protrusions 162 (FIG. 10) may be provided on the inside surfaces of the lids 126, 146 that fit into angled slots 166 on the open ends of the receptacles 128, 148. By inserting the protrusions 162 into the angled slots 164 and turning a lid 126, 146 (relative to the receptacle 128, 148), the lid 126, 146 may be locked onto the receptacle 128, 148.

Figure 10:
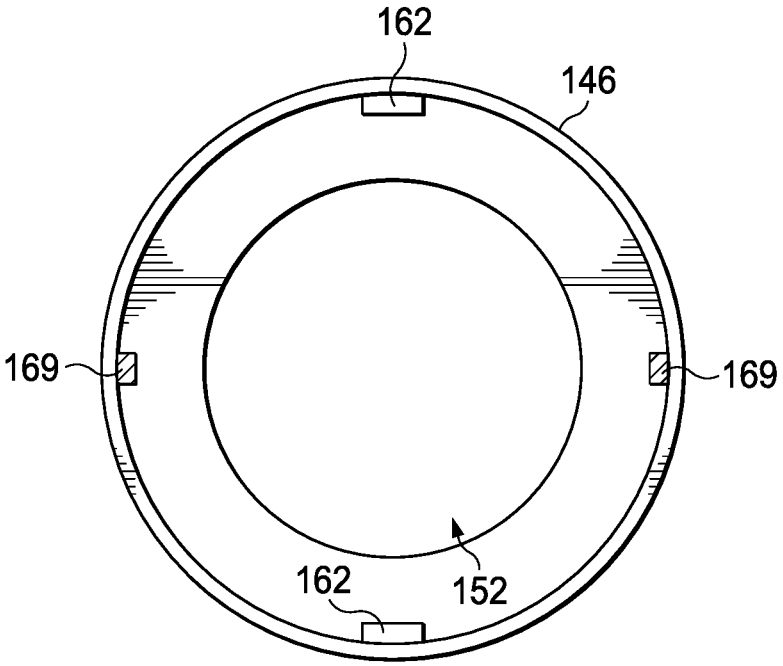
FIG. 10 is a bottom cross-sectional view of the lid of the collecting container of FIG. 7.

Further, in other embodiments, the dispensing container 120 and/or the collecting container 140 may include an assembly 166 for removing items 10 from the containers 120, 140. The assembly 166 shown includes a bottom 168 and two arms 169 that connect the bottom 168 to the lid 126 of the collecting container 140 (FIG. 10). The bottom 168 may be circular, corresponding to the cylindrical shape of the collecting container 140, and the arms 169 may be attached to the inside surface of the lid 146. The assembly 166 may be inserted into the collecting container 140 as the lid 146 is being coupled to the receptacle 148. The bottom 168 may serve as a backstop for any items 10 placed therein such that when the lid 146 is removed, the bottom 168 urges the items 10 out of the collecting container 140.

Figure 11:
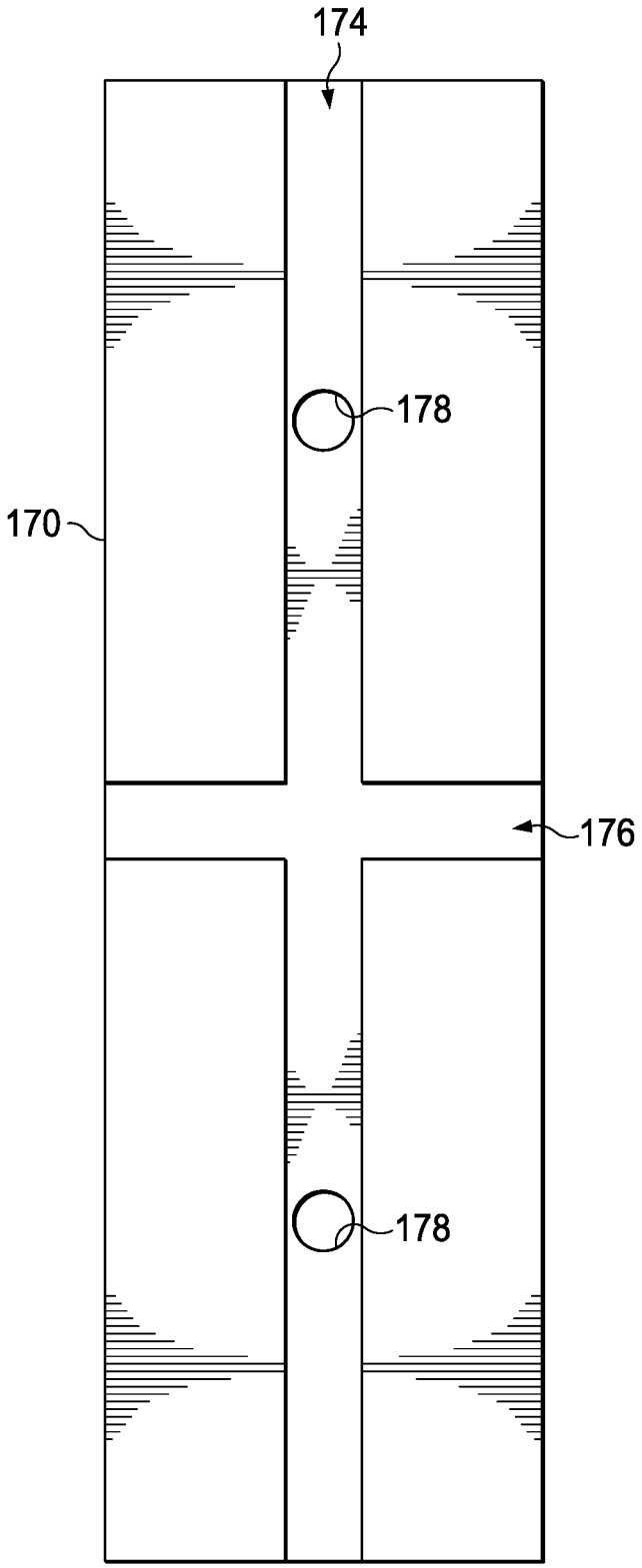
FIG. 11 is a rear view of the mount of the collecting container of FIG. 7.

The dispensing container 120 and the collecting container 140 may each be provided with their own mounts 170 (compared to only one mount 70 in the first embodiment). In doing so, the collecting and dispensing containers 120, 140 no longer have to be attached to the same structure 90. Further, each mount 70 may be configured to correspond to the shape of the containers 120, 140 and/or the shape of the structure 90 to which it is to be attached. For example, the mounts 70 shown in FIGS. 7-9 include a concave surface 172 corresponding to the cylindrical shape of the containers 120, 140. Additionally, these mounts 170 also include channels 174, 176 within which structures of non-solid construction such as rails, poles, fences, and the like may be received (FIG. 11).

Further, the dispensing container 120 and the collecting container 140 may be configured for removable attachment to their mounts 170. The ability to remove the containers 120, 140 facilitates ease of loading/emptying, while also enabling the mounts 170 to be secured to a structure 90 (e.g., by way of screws insertable 176 into holes 178 in the mounts). As shown, each of the containers 120, 140 may be provided with an elongated dovetail 180 that corresponds to a dovetail slot 182 in the mounts 170, collectively forming sliding dovetail joints (FIG. 9). In exemplary embodiments, these sliding dovetail joints may be standardized (e.g., in size and shape) such that containers 120, 140 and mounts 170 may be interchangeable. Of course, other removable attachment features such as hook-and-loop type attachments, magnets, latches, and the like may also be employed without departing from the scope of the present disclosure.

Figure 12:
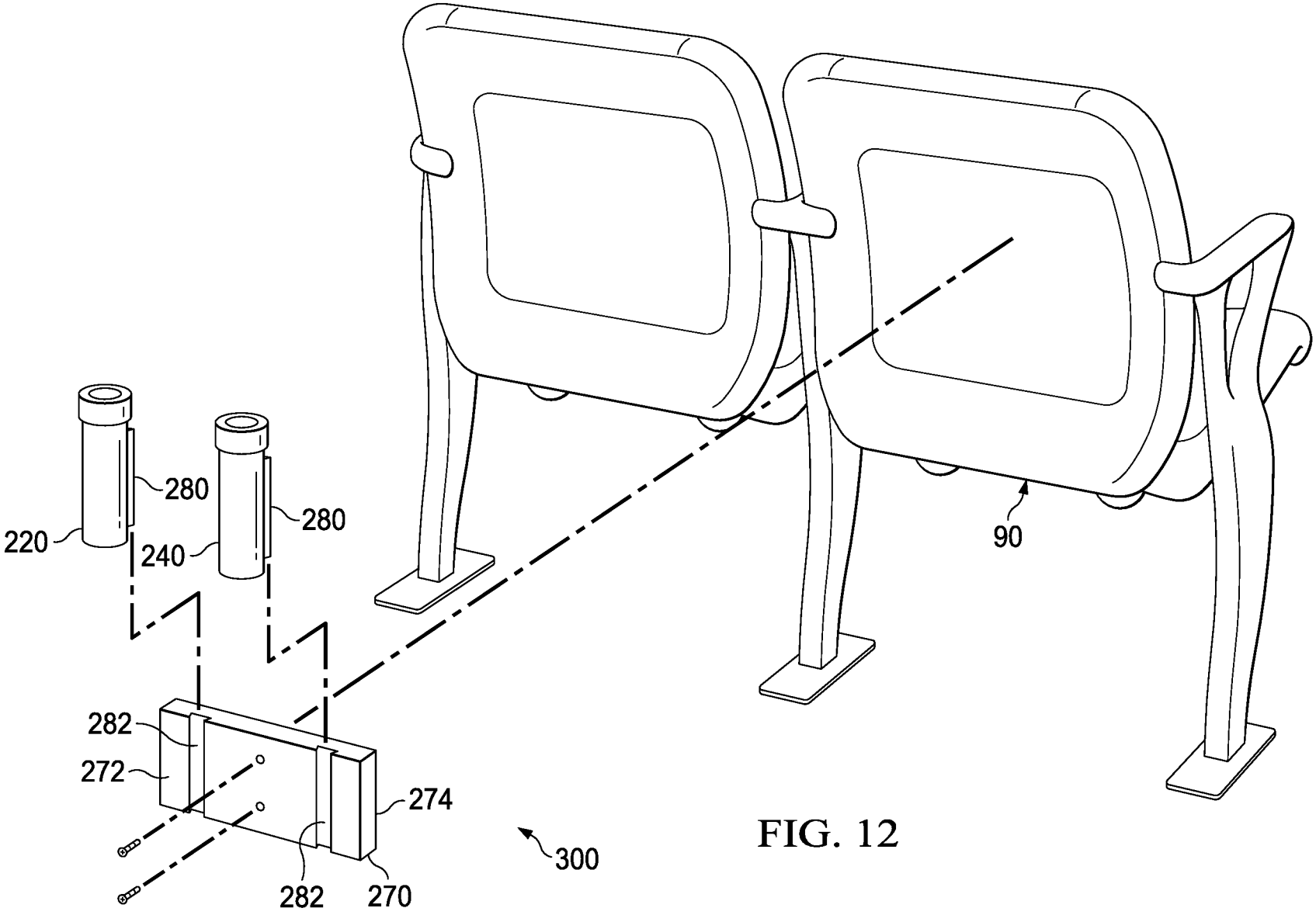
FIG. 12 is an exploded top perspective view of a third embodiment of the apparatus for dispensing and collecting.

Referring to FIGS. 12 and 13, a third embodiment of the apparatus 300 is shown. Here, the dispensing container 220 and the collecting container 240 are the same as in the second embodiment 200, however only one mount 270 is provided. This mount 270 is shown as being generally rectangular in shape, and having a pair of dovetail slots 282 disposed on a first side 272 of the mount 270. These dovetail slots 282 may correspond with the elongated dovetails 280 on the dispensing and collecting containers 220, 240, thereby enabling the dispensing and collecting containers 220, 240 to be releasably attached to the mount 270. The mount 270 further includes a second side 274, shown as being opposite the first side 272, that is configured to interface with a structure 90. By attaching the mount 270 to a structure 90 (such as a stadium seat, preferably the back of a stadium seat), the mount 270 may complete the attachment of the containers 220, 240 to structure 90. As with the first and second embodiments, the third embodiment of the apparatus may be connected to structures 90 by any suitable means such as, but not limited to, the methods previously described above (shown as being attached by way of mechanical fasteners).

Figure 14:
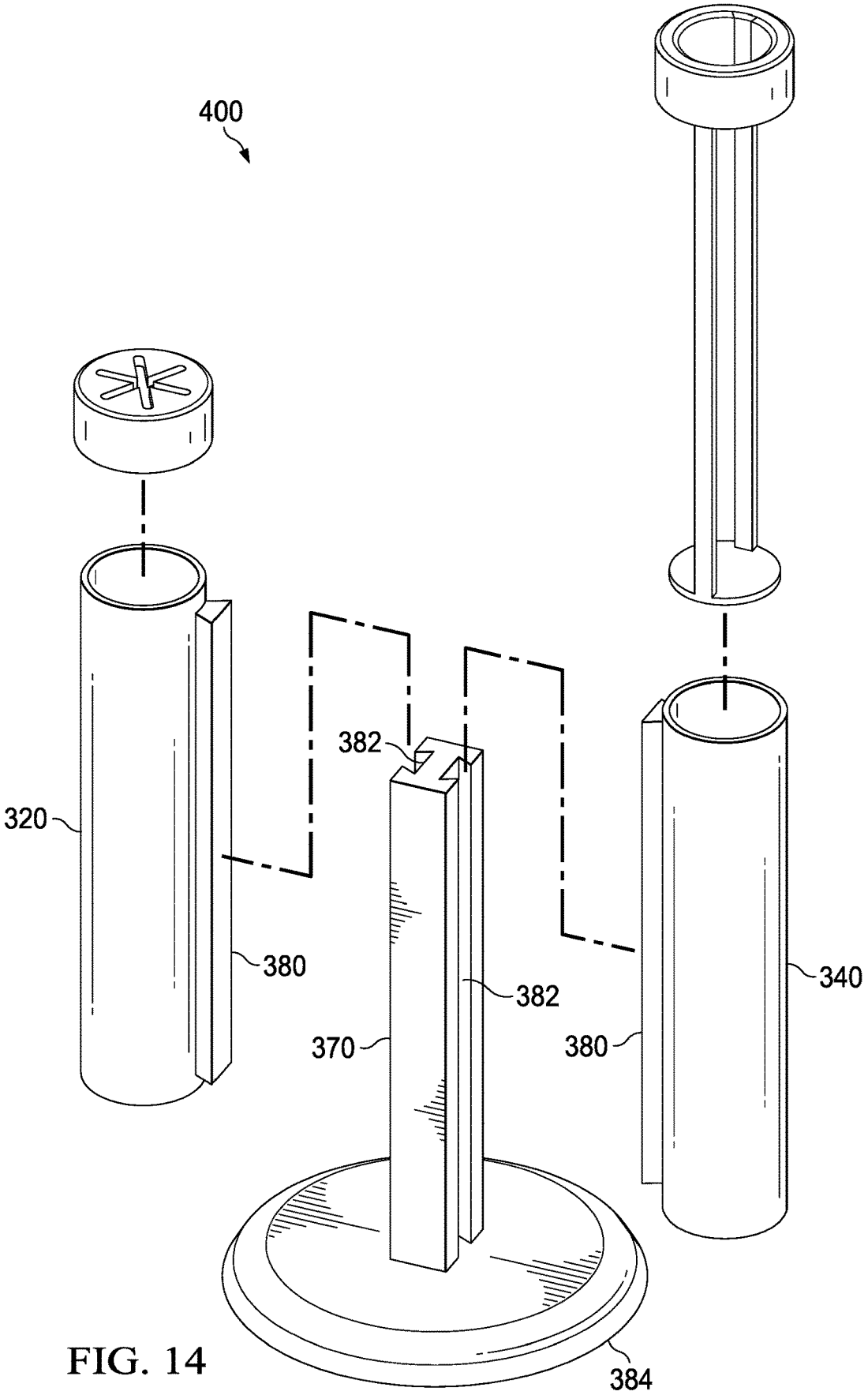
FIG. 14 is an exploded top perspective view of a fourth embodiment of the apparatus for dispensing and collecting.
Figure 15:
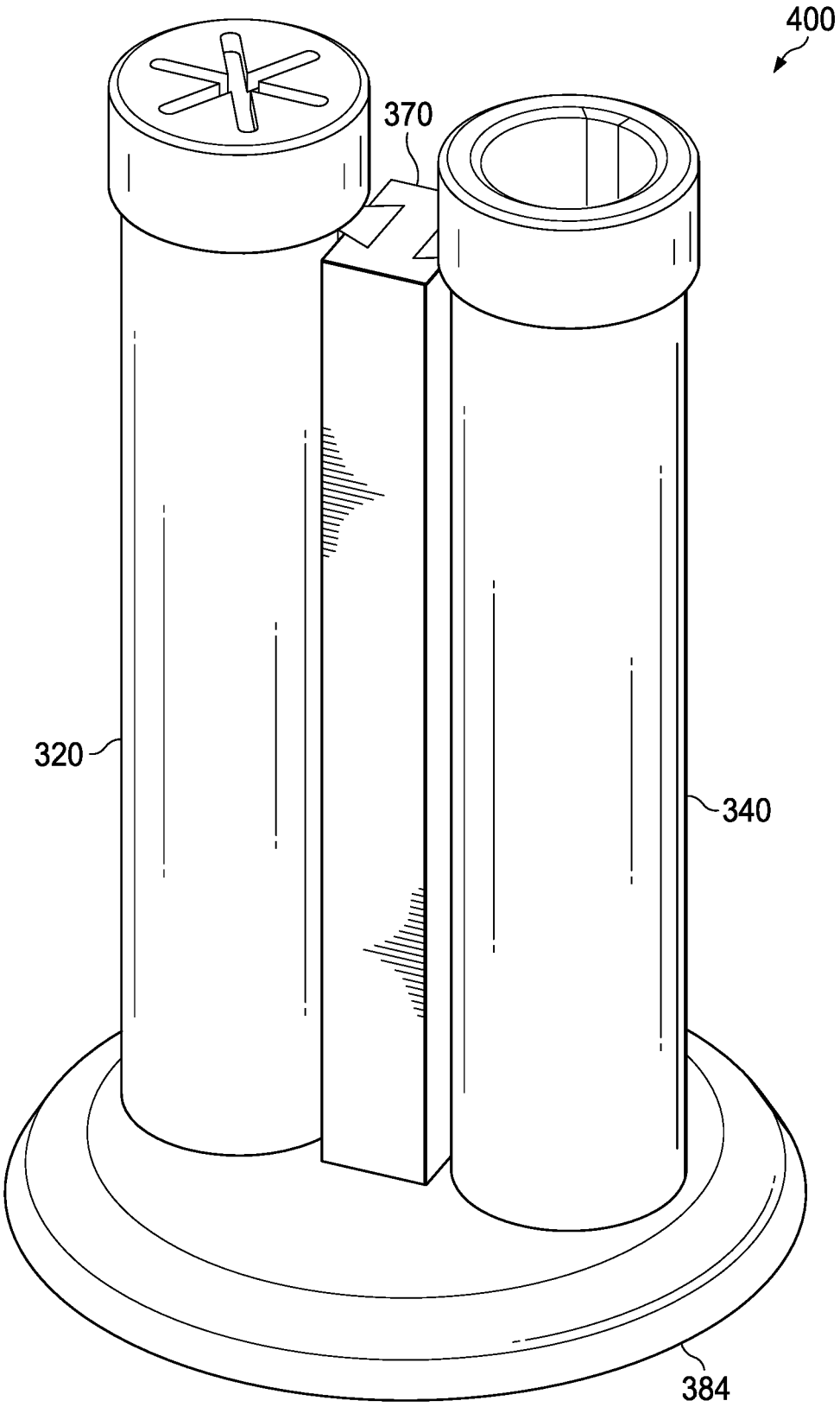
FIG. 15 is a top perspective view of the apparatus of FIG. 14.

Referring to FIGS. 14 and 15, a fourth embodiment of the apparatus 400 is shown. Here, the dispensing container 320 and the collecting container are the same as in the second and third embodiments, with only one mount 370 provided. Both the dispensing container 320 and the collecting container 340 may be attached to this mount 370. The mount 370 includes opposing dovetail slots 382 that correspond to elongated dovetails 380 on the dispensing and collecting containers 320, 340. Further, the mount 370 is also connected on one end to a base 384 which, in effect, may orient the mount 370 and the containers 320, 340 generally upright. The base 384 is shown as being generally circular in shape, though other shapes may also be employed without departing from the scope of the present disclosure.

The apparatus (any of the four embodiments described herein 100, 200, 300, 400 as well other embodiments) may be fabricated from any suitable material. For example, materials such as plastic, metal, and wood may be utilized to fabricate one or more parts of the apparatus (e.g., the dispensing containers, the collecting containers, and/or the mounts). Further, the material compositions need not be the same from part to part. For example, a metal bracket may be utilized with plastic containers. In another example, the entire apparatus may be fabricated from plastic as a single monolithic piece. Whatever the case, it is generally contemplated that the material(s) selected should provide for a lightweight apparatus that is sufficiently resilient to withstand water and/or outdoor environmental conditions.

In one or more embodiments, the dispensing container, the collecting container, the mount, and/or any combinations thereof may include designs, logos, text, and/or the like printed or otherwise shown on their exterior surfaces. These designs/logos/text may be included for informational and/or aesthetic purposes.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An apparatus for dispensing and collecting items comprising:

a dispensing container comprising a first receptacle having an open end, a first lid configured to be received over the open end of the first receptacle, a first interior space defined by the first receptacle and the first lid, and an opening defined in the first lid that extends into the first interior space;

a collecting container comprising a second receptacle having an open end, a second lid configured to be received over the open end of the second receptacle, and a second interior space defined by the second receptacle and the second lid, wherein the collecting container further comprises an opening into the second interior space;

a mount configured to be attached to a structure, wherein the mount is attached to at least one of the dispensing container and the collecting container; and wherein at least one of the dispensing container and the collecting container comprises an assembly for removing items comprising a bottom and one or more arms.

2. The apparatus of claim 1 wherein the dispensing container comprises a top portion and a bottom portion, and the first lid is disposed along the top portion.

3. The apparatus of claim 1 wherein the collecting container comprises a top portion and a bottom portion, and the second lid is disposed along the bottom portion.

4. The apparatus of claim 1 wherein the opening of the collecting container is defined in the second receptacle.

5. The apparatus of claim 1 wherein:

the mount comprises a first side and a second side; and the dispensing container and the collecting container are both connected to the first side of the mount.

6. The apparatus of claim 1 wherein the dispensing container, the collecting container, and the mount are fabricated as a single monolithic piece.

7. The apparatus of claim 1 wherein the at least one of the dispensing container and the collecting container comprises coupling features configured to secure a lid onto a receptacle.

8. The apparatus of claim 1 wherein the mount comprises at least one channels that may be received over at least a portion of a structure.

9. The apparatus of claim 1 wherein:

the mount is configured to be attached to the dispensing container; and the apparatus further comprises a second mount configured to be attached to the collecting container.

10. The apparatus of claim 1 wherein the mount comprises a dovetail slot and at least one of the dispensing container and the collecting container comprises an elongated dovetail that corresponds with the dovetail slot on the mount.

11. An apparatus for dispensing and collecting items comprising:

a dispensing container comprising a first receptacle having an open end, a first lid configured to be received over the open end of the first receptacle, a first interior space defined by the first receptacle and the first lid, and an opening defined in the first lid that extends into the first interior space;

a collecting container comprising a second receptacle having an open end, a second lid configured to be received over the open end of the second receptacle, a second interior space defined by the second receptacle and the second lid, and an opening defined in the second lid that extends into the second interior space;

a mount for attaching the dispensing container and the collecting container to a stadium seat, the mount comprising a first side configured to be releasably attachable to the dispensing container and the collecting container, and second side configured to contact the stadium seat.

12. The apparatus of claim 11 wherein the mount is configured to contact the back of a stadium seat.

13. The apparatus of claim 11 wherein the opening of the dispensing container defines a star shape comprising a circular center point and a plurality of slots extending radially from the circular center point.

14. The apparatus of claim 11 wherein the dispensing container and the collecting container are substantially cylindrical in shape.

15. The apparatus of claim 11 wherein the dispensing container and the collecting container are oriented substantially parallel to one another.

16. The apparatus of claim 11 wherein at least one of the dispensing container and the collecting container comprises a drainage hole.

17. The apparatus of claim 11 wherein at least one of the dispensing container and the collecting container comprises a locking feature.

18. An apparatus for dispensing and collecting items comprising:

a dispensing container comprising a first receptacle having an open end, a first lid configured to be received over the open end of the first receptacle, a first interior space defined by the first receptacle and the first lid, and an opening defined in the first lid that extends into the first interior space, the dispensing container further comprising a first elongated dovetail;

a collecting container comprising a second receptacle having an open end, a second lid configured to be received over the open end of the second receptacle, a second interior space defined by the second receptacle and the second lid, and an opening defined in the second lid that extends into the second interior space, the collecting container further comprising a second elongated dovetail;

a mount comprising a first dovetail slot configured to receive the first elongated dovetail, and a second dovetail slot configured to receive the second elongated dovetail.

19. The apparatus of claim 18 further comprising a base connected to the mount, wherein the base is configured to orient the mount, the dispensing container, and the collecting container, substantially upright.

* * * * *